US005157410A

United States Patent [19]

Konishi

[11] Patent Number: 5,157,410

[45] Date of Patent: Oct. 20, 1992

[54] ADJUSTABLE CELLULAR MOBILE COMMUNICATIONS ANTENNA

[75] Inventor: James T. Konishi, Willowick, Ohio

[73] Assignee: Orion Industries, Inc., Solon, Ohio

[21] Appl. No.: 613,460

[22] Filed: Nov. 9, 1990

Related U.S. Application Data

[63] Continuation of Ser. No. 328,851, Mar. 27, 1989, abandoned.

[51] Int. Cl.[5] ..... H01Q 1/32

[52] U.S. Cl. ..... 343/715; 343/888

[58] Field of Search ..... 343/715, 713, 900, 905, 343/878, 888, 880, 882; 174/138 A, 152 A, 153 A

[56] References Cited

U.S. PATENT DOCUMENTS

| | | | |
|---|---|---|---|
| 3,154,785 | 10/1964 | Taylor | 343/702 |
| 3,898,666 | 8/1975 | Massa | 343/702 |
| 4,104,642 | 8/1978 | Padilla et al. | 343/882 |
| 4,134,121 | 1/1979 | Northcutt | 343/715 |
| 4,136,986 | 1/1979 | Grashow et al. | 343/715 |
| 4,223,314 | 9/1980 | Trey et al. | 343/715 |
| 4,243,989 | 1/1981 | Piper | 343/715 |
| 4,431,332 | 2/1984 | Dieges | 343/888 |
| 4,625,213 | 11/1986 | Horn | 343/715 |
| 4,785,305 | 11/1988 | Shyu | 343/715 |
| 4,827,273 | 5/1989 | Friedberg et al. | 343/715 |

*Primary Examiner*—Michael C. Wimer

*Attorney, Agent, or Firm*—Dressler, Goldsmith, Shore, Sutker & Milnamow

[57] ABSTRACT

An adjustable cellular mobile antenna assembly capable of being mounted on a vehicle in which the angular orientation of the antenna whip or radiator is adjustable relative to the surface on which it is mounted. The antenna member of an adjustable antenna includes a whip or radiator and a support portion. The support portion includes a bottom member, suitably shaped to be receivable in a base attached to the vehicle. The antenna member is angularly adjustable relative to the base and is retained in such a selectable position by a retaining member adapted to engage and interact with both the antenna member and the base and to retain the antenna member in the angular position selected. The antenna assembly is designed to receive and connect to a cable to provide an uninterrupted electrical connection between a transceiver and the antenna whip over all of its angular positions.

8 Claims, 1 Drawing Sheet

ADJUSTABLE CELLULAR MOBILE COMMUNICATIONS ANTENNA

This application is a continuation of application Ser. No. 07/328,851, filed Feb. 27, 1989, now abandoned.

FIELD OF THE INVENTION

The present invention relates to communications antennas, and more particularly to mobile communications antennas, particularly those used for frequencies in the cellular telephone band in the area of 800 MHz frequency band of the type adapted to be mounted on the vehicle.

BACKGROUND OF THE INVENTION

The increasing popularity of mobile communications has resulted in modifications in antennas to suit the developments in communications devices. Even so, prior to mobile cellular phone service, mobile communications were most often found in use by either hobbyists or professionals who required the communications capability for business purposes. In this regard, most vehicles in which mobile communications systems were installed were not personal or luxury type vehicles.

With the explosion of cellular phone service, however, mobile communications installations have expanded to include almost all types of vehicles and users. Phones are being installed in fleets, executive vehicles, and personal vehicles. With the everincreasing utilization, particularly in the 800 MHz cellular phone environment, antenna technology, and the number of differing environments in which antennas may be installed has increased to a point where the numbers of antennas that might be required to accommodate the possible installation variations and vehicle configurations could become prohibitively expensive for those who have to maintain an inventory of such components.

The advent of cellular radio telephone service has resulted in increases in the number of antennas sold and installed. As a result of the growing awareness of cellular service, interest in private mobile radio systems is also increasing.

From an operational point of view, roof-top antenna installation usually results in the best performance, mainly because of additional height, absence of reflections, an unobstructed view in azimuth, and the symmetry of radiation patterns, all of which contribute to the greatest omnidirectional coverage. However, a roof-top antenna installation is not the automatic choice. Such an installation may be impractical, as in the case of a convertible. It is often undesirable because vehicle owners do not wish to have holes drilled in the roof of their vehicles. Roof construction is making roof-top installations more and more difficult. Roof walls are becoming thinner, ribbed double paneling and molded headliners make it difficult to route cabling and limit natural cable access. When roof-top installations are difficult, they are time-consuming and expensive.

Good mobile performance is the result of a number of factors, one of which is a good omnidirectional radiation pattern. Mounting locations other than roof-tops tend to present some compromises because of lower height and the potentially asymmetrical pattern resulting from vehicle body obstructions. Antennas installed at alternative locations can maintain very nearly as good a performance characteristic as the roof-top installations.

One very popular and successful alternative is an antenna that is mounted on the window of a vehicle. This antenna serves as a practical solution for customers and users who object to drilling holes in the vehicle. The window-mounted antenna is easily and quickly attached to a glass, plastic, or fiberglass surface, e.g., a windshield or rear window, making it possible to select a location based on the simplest path for the cable connection to the radio telephone. Furthermore, when mounted near the top of such a window, the antenna can extend above the adjacent surface and provide a good uniform omnidirectional radiation pattern.

Another excellent alternative to the roof-top installation is an elevated feed point antenna. This antenna includes a lower mast in the form of an isolation skirt or sleeve and a choke contained in the lower mast. The antenna requires no ground plane, and the higher center of radiation achieved by the elevated feed design addresses a major cause of pattern distortion and signal loss, which can be experienced when antennas designed for roof-top installation are mounted at alternative lower locations, such as on trunks or cowls.

Because of the wide variety of vehicle shapes, one of the problems with a trunk or cowl installation is that the antenna is not vertically oriented when installed on a slanted surface. While various adjustable antennas exist, one of the problems in the 800 MHz band is to avoid deterioration of operating characteristics, which is more critical at these frequencies than at the lower frequencies at which antennas have been used in the past. Thus, the use of an antenna properly designed to meet the requirements of a particular mounting location is important at the 800 MHz band.

At these cellular frequencies, some of the mechanical problems of antenna design are reduced. For example, full-length whips are shorter and, therefore, less subject to problems of angular deflection or the necessity to produce antennas in which physical length differs from electrical length, such as is the case for most antennas used in the CB frequency bands. Other problems are more severe.

Thus, although the 800 MHz cellular band antenna looks deceivingly simple, there are a number of factors that must be addressed in order to produce a successful antenna. Noise generation from mechanical components which might go unnoticed at lower frequencies can utterly destroy the integrity of an 800 MHz type antenna that depends on secondary data transmission for proper operation or cell site and channel switching. Mechanical components and connections must be highly resistant to normal vibrations, as well as corrosion, which can lead to noise generation in such duplex communications systems.

High-grade coaxial cable is to be used, and the connections between the cable and the antenna can create trouble spots, particularly where low noise is essential to accurate communications.

Existing elevated feed and other trunk or cowl mount antennas are designed to be installed in the center of the trunk or cowl where a hole can be drilled through the trunk lid or the cowl. Alternatively, there are designs which are designed to clip or be screwed to the edge of a trunk. As indicated above, however, such installations may result in the antenna not being vertically oriented.

It would, therefore, be desirable to be able to have a trunk or cowl mounted antenna, such as an elevated feed antenna, adapted for mounting to a variety of surfaces having different angular orientations, which is adjustable and capable of orienting the antenna in a desired plane, typically the vertical, without producing deterioration in the operating characteristics of the antenna.

SUMMARY OF THE INVENTION

In accordance with the present invention there is provided an adjustable cellular mobile antenna assembly capable of being mounted on a vehicle in which the angular orientation of the antenna whip or radiator is adjustable relative to the surface on which it is mounted.

The antenna member of an adjustable antenna incorporating the present invention includes a whip or radiator and a support portion. The support portion includes a bottom member, suitably shaped to be receivable in a base attached to the vehicle. In the case of an elevated feed antenna, the support portion can include a skirt or sleeve extending between and interconnecting the bottom member and the whip. The antenna member is angularly adjustable relative to the base and is retained in such a selectable position by a retaining member adapted to engage and interact with both the antenna member and the base and to retain the antenna member in the angular position selected.

The antenna assembly incorporating the present invention is designed to receive and connect to a cable to provide an uninterrupted electrical connection between a transceiver and the antenna whip over all of its angular positions. This permits the selective positioning of the antenna while maintaining the integrity of the electrical connection, which is so important in the cellular frequency band.

The coaxial cable, which connects the antenna to a transceiver disposed remotely therefrom within the vehicle, passes through the base attached to the vehicle through the antenna bottom portion into the sleeve or skirt of the antenna, if used, and is suitably connected to the antenna whip, e.g., through appropriate circuitry. In the case of an elevated feed antenna, the cable is connected to the antenna or circuitry associated therewith within the sleeve portion.

In this regard, the bottom portion of the antenna is provided with an aperture sufficiently large to allow passage therethrough of the antenna cable at the various selectable angular orientations of the antenna member relative thereto. The angular orientation of the antenna member is limited by its engagement with the upper end of the retaining member which surrounds the antenna member. The bottom member of the antenna, which is receivable in the base, is spaced from the bottom of the base to provide a cable receiving recess or compartment through which the cable passes.

More specifically, the base defines a generally annular antenna support, which includes a sealing member engageable with the bottom portion of the antenna. The curvilinear bottom portion of the antenna seats in the base to form a generally watertight seal therewith. The antenna support or seat of the base is spaced above the bottom or platform area of the base to define a compartment or recess therein, which forms a gap for receiving at least a portion of the cable to permit angular adjustment of the antenna.

The antenna bottom portion, which seats in the generally annular seat of the base, is typically spherical in shape. A generally axial aperture is formed in the bottom portion in alignment with the antenna whip and the axis of the sleeve. The aperture is sufficiently large so that at least a portion thereof is exposed to the base compartment to allow passage of the cable therethrough at the various angular orientations of the antenna member relative to the base.

A generally cylindrical retaining member or collar has an inwardly disposed upper lip or flange portion, which can include a sealing member. The lip engages the upper surfaces of the spherical antenna bottom portion and is sealable thereagainst as the collar is tightened on the base. The spherical bottom portion of the antenna member is retained in, and gripped between, the seat of the base and the lip of the collar, and is held in position as the collar is tightened onto the base.

The adjustable antenna incorporating the present invention is capable of having the antenna member, and therefore, the radiating whip at one end thereof, oriented at a wide variety of angles relative to the axis of the base while allowing a direct cable connection to the antenna by a cable passing through the base and the bottom portion of the antenna member seated on the base.

Numerous other advantages and features of the present invention will become readily apparent from the following detailed description of the invention and the embodiments thereof, from the claims, and from the accompanying drawings in which the details of the invention are fully and completely disclosed as a part of this specification.

DETAILED DESCRIPTION

Figure 1:
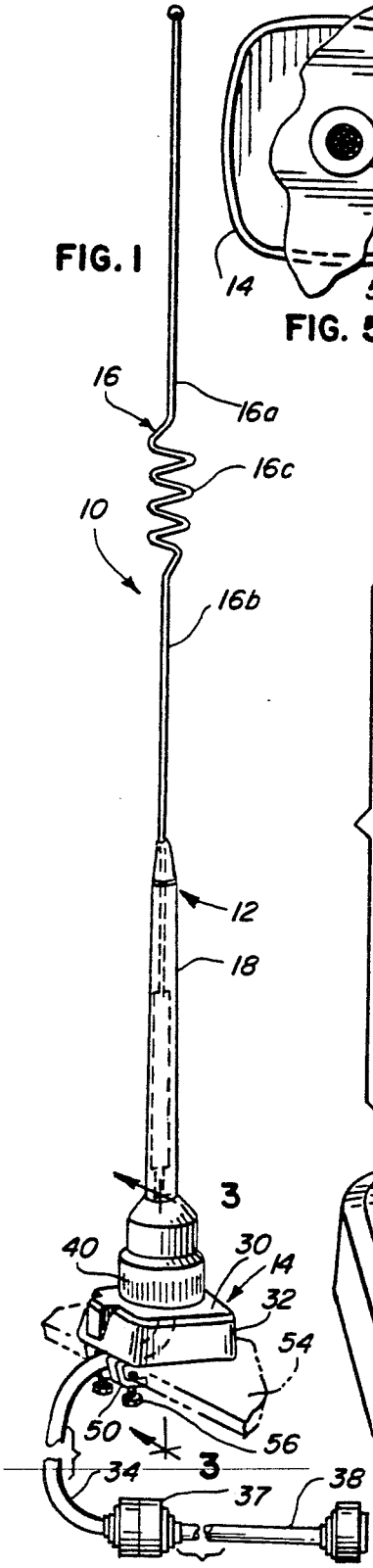
FIG. 1 is a perspective view of one embodiment of an adjustable cellular mobile communications antenna incorporating the present invention.
Figure 5:
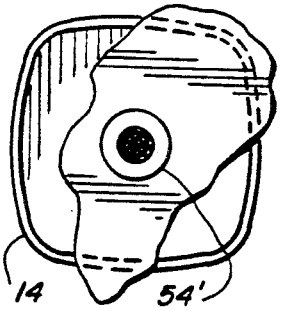
FIG. 5 is a bottom view of an alternative mounting arrangement therefor.
Figure 2:
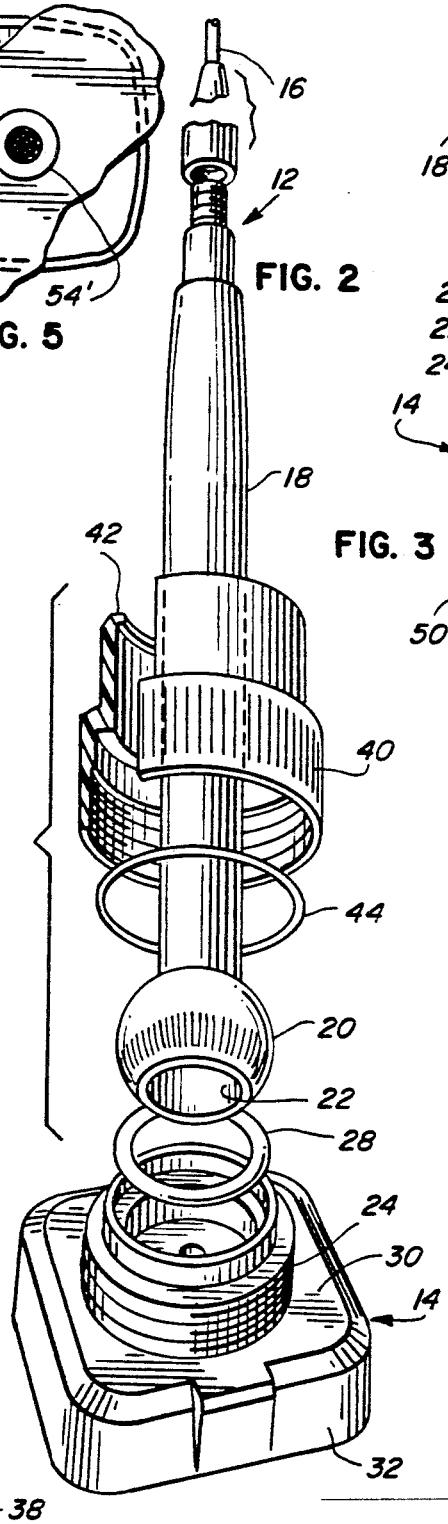
FIG. 2 is an exploded view thereof.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiments illustrated.

An adjustable cellular mobile communications antenna 10 incorporating the present invention includes an antenna member 12 and a base 14. In the case of an elevated feed antenna as shown in the drawings, the antenna member 10 includes a radiating antenna whip 16. As shown, the whip may take the form of a collinear whip having a $\frac{5}{8}$ wavelength portion 16*a* over a $\frac{1}{4}$–$\frac{1}{2}$ wave length portion 16*b* interconnected by a phasing coil 16*c*. One end of the whip 16 is threaded or otherwise removably connected to the upper end of a hollow sleeve or isolating skirt portion 18. The other end of the sleeve 18 terminates in a generally spherical bottom portion or support ball 20.

The spherical bottom portion 20 includes an axial aperture or bore 22 passing therethrough and aligned with the axis of the sleeve portion 18. The lower portion of the bore 22 is enlarged to maintain communication with the inside of a generally cylindrical portion 24 of the base 14 on which the antenna member 12 is supported.

The upper rim 26 of the cylindrical portion 24 may include a sealing member such as 0-ring 28 for sealing engagement with the support ball 20 of antenna member 12. The lower end of cylindrical support portion 24 terminates in a platform 30 with a depending skirt 32. The cylindrical portion 24 is sufficiently high to define a compartment 25 therewithin which receives a cable such as coaxial cable 34, which passes therethrough, through the bore 22 formed in support ball or bottom portion 20 of the antenna member 12 and into the sleeve portion 18 for connection to suitable coupling circuitry 36 which interconnects the cable 34 to the antenna whip 16.

If appropriate, the cable 34 may terminate in an impedance matching connection 37 which is connected to another cable 38 having the correct impedance for connection to a transceiver (not shown) located in the vehicle at a location remote from the antenna 10. For example, the cable 34 may have an impedance of about 75 ohms to match the impedance of the coupling circuitry 36 and/or the antenna whip 16, while the cable 38 may have an impedance of about 50 ohms to match the input impedance of the transceiver to which it is connected.

A coupling collar 40 is threaded to the cylindrical base portion 24 and surrounds the major portion of the support ball 20. The upper portion of collar 40 is formed with in inwardly extending annular lip 42 which engages the upper surfaces of support ball 20 to retain the ball within the collar 40 between lip 42 and rim 26. An sealing ring 44 may be used to provide a weather seal between the collar 40 and the ball 20. The antenna member 12 is adjustable to an infinite number of positions in azimuth. The angular adjustment of the antenna member 12 is limited only by the engagement of the lower end of sleeve portion 16 against the lip 42 of collar 40, as shown in FIG. 3.

Figure 3:
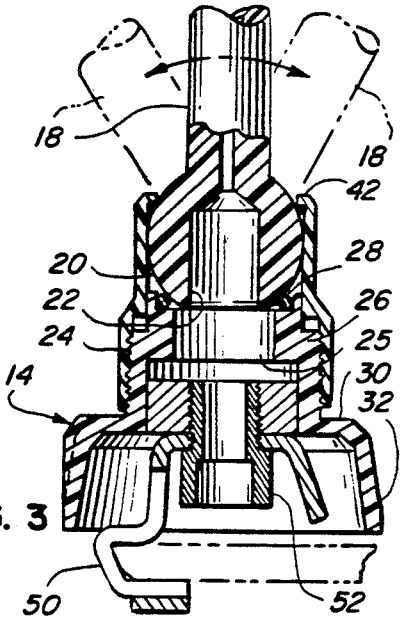
FIG. 3 is an enlarged sectional view taken along the lines 3—3 of FIG. 2.
Figure 4:
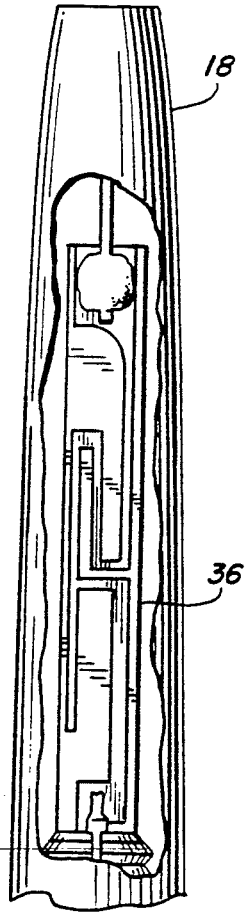
FIG. 4 is partial elevational view of a portion of the antenna sleeve, partially broken away to show coupling circuitry therewithin.

As indicated above, the lower end of bore 22 in ball 20 is sufficiently large so that a portion of the bore is exposed to the compartment 25 at the maximum angular deflection of the antenna member 12 as shown in FIG. 3. This permits the cable 34 to pass from compartment 25 into bore 22 at all of the selectable angular positions of the antenna member 12.

The antenna 10 is connected to a vehicle by suitable connector as is known. As shown in FIGS. 1 and 3, a clamp 50 is attached to the base 14 by a headed stud 52 threaded to the bottom of the base 14. The clamp is designed to be attached to the edge of a support such as a trunk lid 54 (FIG. 1). Typically, a plurality of set screws 56 are threaded through the end of clamp 50 and engage the under side of lid 54 to hold the antenna in place. Alternatively, the threaded stud 52 is longer and is passed through a hole formed in a support such as the center of a trunk lid 54, or a cowl.

Thus there has been disclosed an adjustable cellular mobile communications antenna capable of being mounted and support on surfaces of various angular orientations and configurations. The adjustable cellular mobile communications antenna incorporating the present invention has a wide range of selectable angular adjustments to permit orientation of the antenna in a desired plane, such as the typical vertical plane. In addition, if the configuration of the support surface is drastically different from expectations, the base or skirt can be selected to conform to the desired shape without having to stock a variety of complete antenna assemblies.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. A mobile communication antenna for mounting on a support surface of a vehicle, comprising:

an electrically non-conductive base member attachable to the vehicle and defining a support;

an antenna member having an electrically conductive radiating portion and an electrically non-conductive, generally curvilinear bottom portion at one end thereof, said bottom portion being adapted to engage, be supported on, and be angularly movable relative to said base member;

electrically non-conductive retaining means spaced from said support surface and interacting with said base member and said antenna member, said retaining means being selectively operable to retain said antenna member at a selected one of a plurality of selectable angular positions relative to said base member; and cable means connected to said electrically conductive radiating portion of said antenna member for connecting said radiating portion to a transceiver located remotely therefrom, said cable means passing through said base member for connection to said conductive radiating portion of said antenna member.

2. An antenna as claimed in claim 1, wherein:

said electrically non-conductive antenna bottom portion includes an aperture passing therethrough; and said cable means passes through said base member and said aperture for connection to said conductive radiating portion.

3. An antenna as claimed in claim 2, wherein:

said electrically conductive radiating portion is spaced away from said electrically non-conductive antenna bottom portion.

4. An antenna as claimed in claim 3, wherein:

said base member comprises a generally cylindrical body portion adapted to extend up from said vehicle support surface and terminating in a generally annular, electrically non-conductive support rim, said cylindrical body portion defining a compartment therewithin for receiving said cable means passing therethrough; and said aperture formed in said antenna bottom portion is sufficiently large to have at least a portion thereof accessible from said compartment at all of said selectable angular positions of said antenna member for permitting passage of said cable means through said compartment and said aperture.

5. An antenna as claimed in claim 2, wherein:

said antenna member includes a radiating antenna whip spaced from said antenna bottom portion and a sleeve portion disposed between and interconnecting said whip and said bottom portion; and including means disposed within said sleeve portion for coupling said cable means to said radiating whip.

6. An antenna as claimed in claim 5, wherein:

said coupling means comprises coupling circuitry disposed within said sleeve portion coupling said cable means to said antenna radiating whip.

7. An antenna as claimed in claim 1 wherein:

said retaining means surrounds portions of said antenna bottom portion and said base member;

said retaining means is selectively operable to allow adjustment of said antenna member to said selected one of said plurality of selectable angular positions relative to said base member; and said retaining means includes means engageable with said base member for retaining said antenna member in said one of said selectable angular positions.

8. A mobile communications antenna mountable on a support surface of a vehicle;

a base member attachable to the vehicle support surface, including a generally annular body portion adapted to extend up from said vehicle support surface and terminating in a generally annular, electrically non-conductive support rim, said body portion defining a compartment therewithin;

an antenna member having an electrically conductive radiating portion at one end thereof, an electrically non-conductive, generally curvilinear bottom portion at the other end thereof, and a non-conductive sleeve portion disposed between and mechanically interconnecting the spaced-apart radiating and bottom portions;

said antenna member curvilinear bottom portion, including an aperture passing therethrough and communicating with the interior of said sleeve portion;

said antenna member curvilinear bottom portion engaging and being supported on said support rim to permit angular movement of said antenna member relative to said base member;

electrically non-conductive retaining means selectively interacting with said base member, and said antenna member to retain said antenna member at a selected angular position relative to said base member;

cable means for connecting said electrically conductive radiating portion to a transceiver located remotely therefrom, said cable means passing into said base member and being received in said compartment, one conductor of said cable means passing through said base member body portion into said sleeve portion through the aperture formed in said curvilinear bottom portion; and circuit means disposed in said sleeve portion interconnecting said conductive radiating portion, and said conductor of said cable means for coupling said cable means to said radiating portion.

* * * * *